US007293601B2

(12) United States Patent
Huang

(10) Patent No.: US 7,293,601 B2
(45) Date of Patent: Nov. 13, 2007

(54) THERMODUCT

(75) Inventor: Kuo-Wen Huang, Hsinchu County (TW)

(73) Assignee: Top Way Thermal Management Co., Ltd., Hsinchu County (TW)

( * ) Notice: Subject to any disclaimer, the term of this patent is extended or adjusted under 35 U.S.C. 154(b) by 318 days.

(21) Appl. No.: 11/152,228

(22) Filed: Jun. 15, 2005

(65) Prior Publication Data

US 2006/0283574 A1 Dec. 21, 2006

(51) Int. Cl.
*F28D 15/00* (2006.01)

(52) U.S. Cl. ..... 165/104.26; 165/104.33

(58) Field of Classification Search ..... 165/104.26, 165/104.21, 104.33
See application file for complete search history.

(56) References Cited

U.S. PATENT DOCUMENTS

| | | | | |
|---|---|---|---|---|
| 4,003,427 | A * | 1/1977 | Leinoff et al. | 165/104.26 |
| 7,040,382 | B2 * | 5/2006 | Hsu | 165/104.26 |
| 7,086,454 | B1 * | 8/2006 | Hsu | 165/104.26 |
| 2002/0124995 | A1 * | 9/2002 | Moon et al. | 165/104.11 |
| 2005/0284614 | A1 * | 12/2005 | Machiroutu et al. | 165/104.26 |
| 2006/0037737 | A1 * | 2/2006 | Chen et al. | 165/104.26 |
| 2006/0180296 | A1 * | 8/2006 | Liu | 165/104.26 |
| 2006/0201655 | A1 * | 9/2006 | Hong et al. | 165/104.26 |
| 2006/0207749 | A1 * | 9/2006 | Hsu | 165/104.26 |
| 2006/0207750 | A1 * | 9/2006 | Chang et al. | 165/104.26 |
| 2006/0213646 | A1 * | 9/2006 | Hsu | 165/104.26 |
| 2007/0034357 | A1 * | 2/2007 | Hou et al. | 165/104.26 |
| 2007/0089864 | A1 * | 4/2007 | Chang et al. | 165/104.26 |

FOREIGN PATENT DOCUMENTS

| | | | |
|---|---|---|---|
| JP | 58127091 A | * | 7/1983 |
| JP | 59084085 A | * | 5/1984 |
| TW | 572250 | | 1/2004 |

* cited by examiner

*Primary Examiner*—Allen J. Flanigan
(74) *Attorney, Agent, or Firm*—Birch, Stewart, Kolasch & Birch, LLP.

(57) ABSTRACT

A thermoduct comprises a metallic tube with multiple trenches, cupric powder and a metallic net, wherein the metallic net and the cupric powder are disposed inside the metallic tube and function as a capillary texture. The cupric powder is sintered to adhere to recesses of trenches, and the metallic net is sintered to adhere to the inner wall of the metallic tube. In the present invention, the metallic net can confine the cupric powder inside the gap between the metallic net and the inner wall of the metallic tube, which enables the cupric powder to be sintered to firmly adhere to the recesses of the trenches; thus, the thermoduct can simultaneously have capillarity, permeability and thermal conductivity, and the backflow of the liquid working fluid is speeded up.

4 Claims, 6 Drawing Sheets

THERMODUCT

FIELD OF THE INVENTION

The present invention relates to a thermoduct, more particularly to a thermoduct having high heat-dissipating efficiency.

BACKGROUND OF THE INVENTION

With the rapid development of the 3C hi-tech industry, the 3C electronic products present advanced and novel designs persistently. However, the heat-dissipating problems also arise with the promoted efficacy of the electronic products. Therefore, most of the electronic products are equipped with heat-dissipating modules to drain the heat generated inside the electronic products.

Exemplified by the computer, if the heat generated by the electronic elements cannot be drained, the temperature will rise, which induces the computer to crash or even stop operating. Therefore, a general PC always has heat-dissipating fins and electric fans. The heat-dissipating fins are made of multiple metallic plates and used to increase heat-dissipating area. In addition to increasing heat-dissipating area, an electric fan, which generates an enforced air stream to blow away the heat, is also needed. However, the heat-dissipating efficiency of the aforementioned heat-dissipating fins is inferior, which results in that heat cannot be drained rapidly. Therefore, an advanced technology—thermoduct—had been developed.

The thermoduct is an enclosed metallic tube containing an appropriate amount of working fluid, such as pure water or acetone. The working fluid is in vacuum state, and when the heated end of the thermoduct absorbs heat, the working fluid is evaporated, and the vapor of the working fluid will flow to the cooling end of the thermoduct where the pressure is lower. The vapor of the working fluid will then be condensed and releases latent heat in the cooling end. The condensed working fluid will flow back to the heated end via capillarity. Heat dissipation is therefore achieved via the cycling of evaporation and condensation.

The speed of the vapor is much higher than that of the liquid in the thermoduct; therefore, the backflow speed of the liquid working fluid is a critical factor in the heat-dissipating efficiency. Conventional thermoducts utilize the capillary texture of engraved trenches or metallic nets thereinside to speed up the backflow liquid working fluid. Further, cupric powder can also be sintered to the inner wall of the metallic tube to form a layer of porous material, which can enhance the capillary effect and helps the liquid working fluid flow back.

Taiwan Patent Publication No. 572250 discloses a thermoduct adopting cupric powder as capillary texture, and the fabrication process thereof is shown in FIG. 1A~FIG. 1C Prior Art. A tube 100 has an open end 102 and a closed end 104, as shown in FIG. 1A Prior Art. A cupric rod 110 is inserted through the open end 102 into the tube 100, and then, cupric powder 120 is filled into the gap between the cupric rod 110 and the inner wall of the tube 100. The cupric powder 120 is sintered to adhere to the inner wall of the tube 100, as shown in FIG. 3B Prior Art, and next, the cupric rod 110 is drawn out to form a hollow portion 106, as shown in FIG. 3C Prior Art. The tube 100 is then evacuated, and working fluid (not shown in the drawing) is filled thereinto, and lastly, the open end 102 is sealed. Via the cupric powder 120, heat can be conducted rapidly, and a better heat-dissipating effect can be achieved.

However, in the fabrication process of the abovementioned thermoduct, a portion of the cupric powder 120 will be drawn out also in the step of drawing out the cupric rod 110, and thus, the amount of the cupric powder 120 sintered to the inner wall of the tube 100 is lessened. Further, the fabrication of the abovementioned thermoduct is uneasy, manpower-consuming, time-consuming, and expensive.

SUMMARY OF THE INVENTION

The primary objective of the present invention is to provide a thermoduct with high heat-dissipating efficiency.

To achieve the aforementioned objective, the thermoduct of the present invention comprises a tube, a metallic net and cupric powder, wherein the metallic net and cupric powder are disposed inside the metallic tube and function as a capillary texture. The inner wall of the tube has multiple trenches in order to increase the surface area of the inner wall and raise the capillarity for working fluid, which can promote the thermal conductivity and the permeability. The metallic net is inserted into the tube in order to promote the capillarity of the tube and to confine the cupric powder inside the gap between the metallic net and the inner wall of the tube, i.e. to confine the cupric powder inside the trenches. In comparison with the cupric rod used in the conventional technology, drawing out the metallic net is unnecessary in the present invention, so that in the present invention, the cupric powder can be free from being drawn out. The cupric powder adhering to the trenches can increase capillarity in the thermoduct. Further, the cupric powder and the metallic net will be sintered to adhere to the inner wall of the tube to provide working fluid with capillary texture, which is needed in the back flow of the working fluid.

In the present invention, the objective of dissipating heat is achieved via the cycling of absorbing/dissipating heat of the working fluid inside the thermoduct. The trenched tube incorporated with the capillary texture of the cupric powder and the metallic net enables the thermoduct of the present invention to have capillarity, permeability and thermal conductivity simultaneously, and thus, the backflow rate of the liquid working fluid is speeded up. The metallic net's taking the place of cupric rod enables the powder to firmly adhere to the trenches inside the tube, which can promote heat-dissipating effect.

DETAILED DESCRIPTION OF THE PREFERRED EMBODIMENTS

FIG. 1A~FIG. 1C Prior Art illustrate schematically the fabrication method of a conventional thermoduct.

DETAILED DESCRIPTION OF THE INVENTION

Figure 1A:
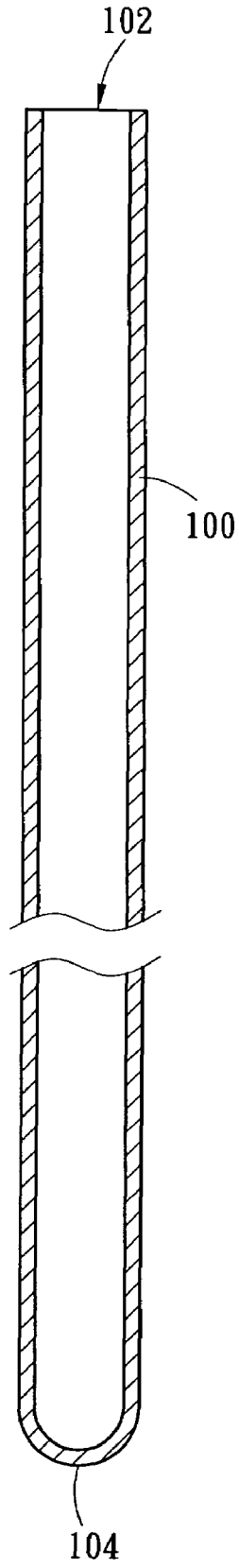
Fig.1A PRIOR ART
Figure 1B:
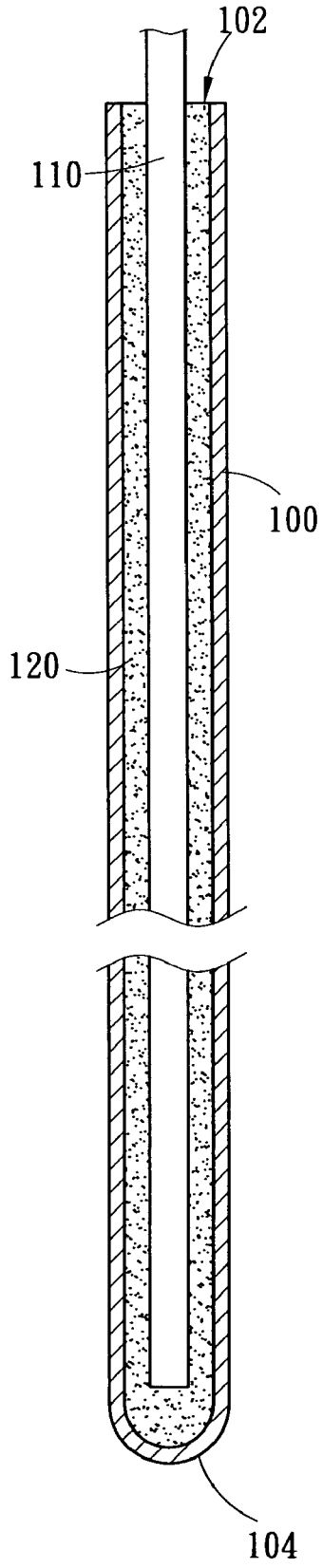
Fig.1B PRIOR ART
Figure 1C:
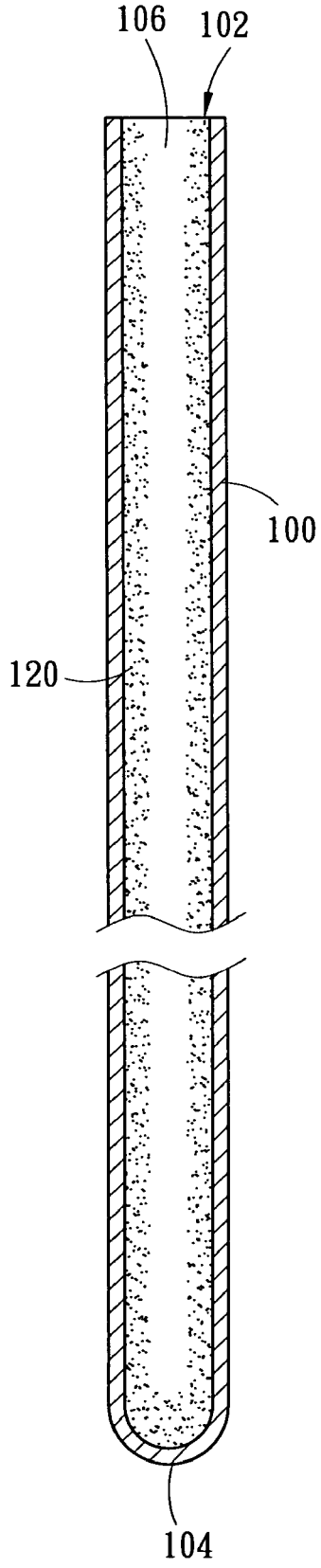
Fig.1C PRIOR ART
Figure 2:
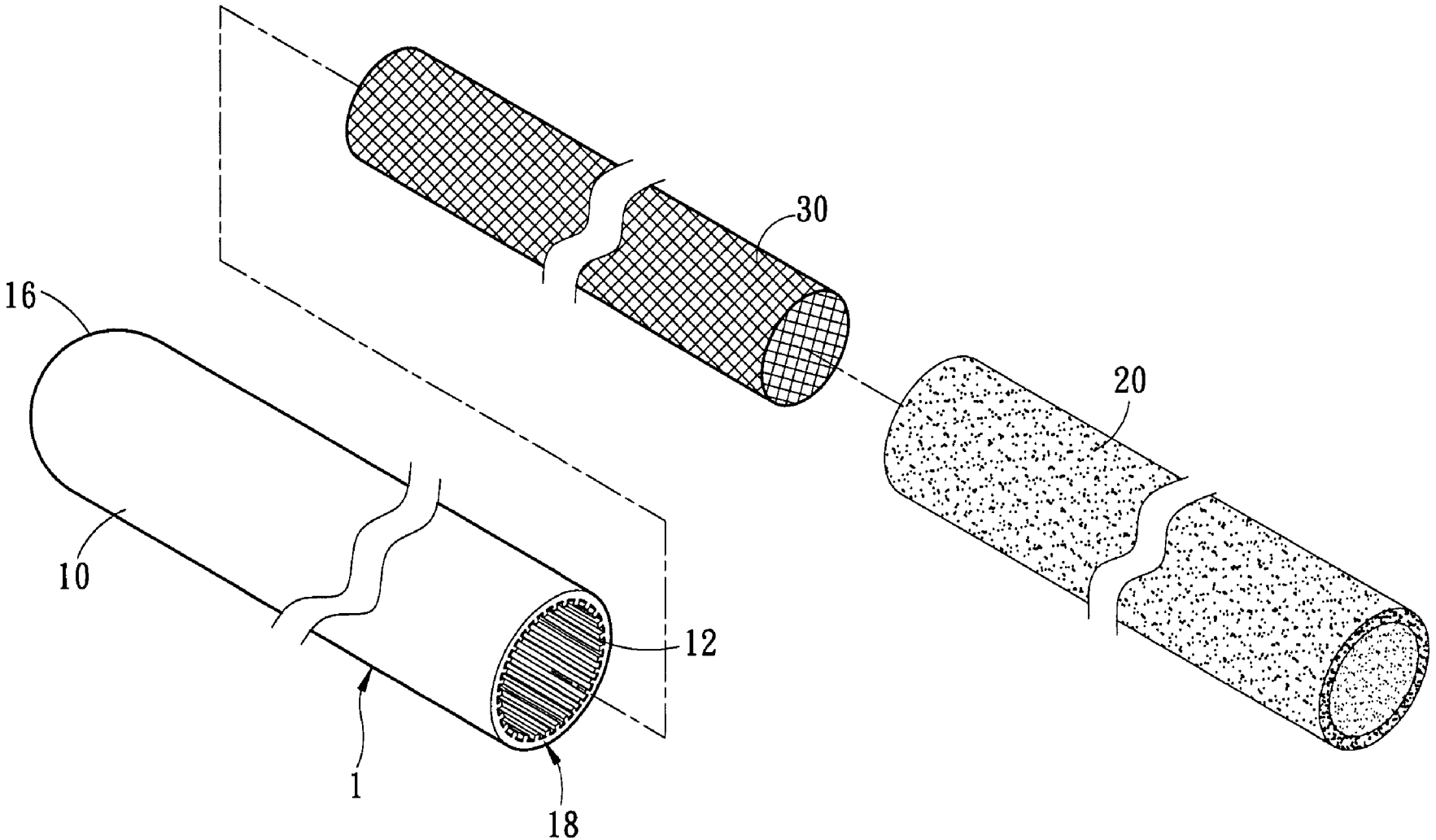
FIG. 2 illustrates schematically the structure of the thermoduct according to one embodiment of the present invention.

Refer to FIG. 2 disclosing a preferred embodiment of the thermoduct 1 of the present invention. The thermoduct 1 comprises a tube 10, cupric powder 20, and a metallic net 30, wherein the cupric powder 20 and the metallic net 30 are disposed inside the metallic tube 10 and function as a capillary texture.

Figure 3:
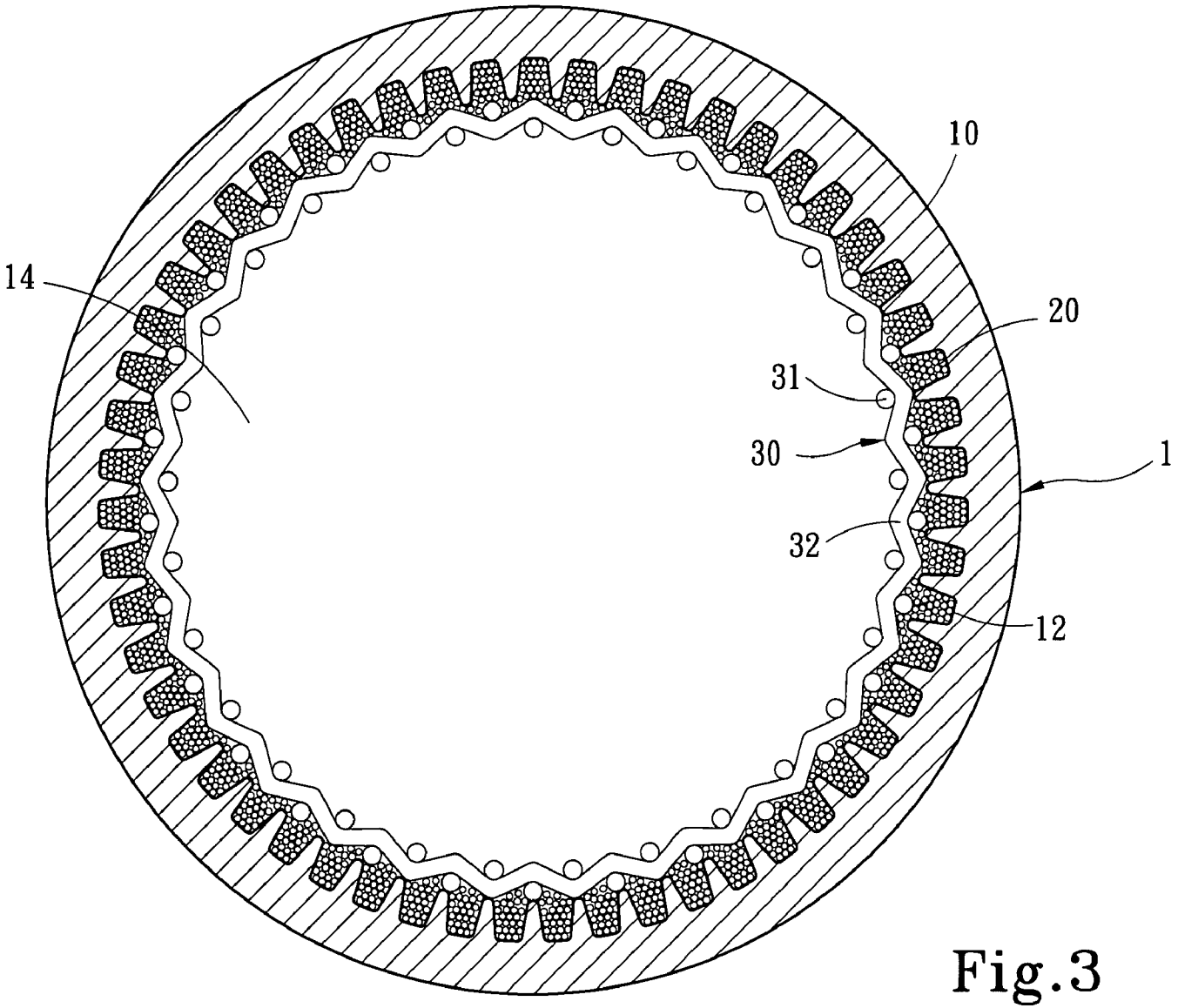
FIG. 3 shows schematically a sectional view of the thermoduct according to one embodiment of the present invention.

Referring to FIG. 3, the tube 10 has an axial hollow portion 14, and the hollow portion 14 has an appropriate amount of working fluid (not shown in the drawing), such as pure water or acetone, and via the cycling of absorbing/dissipating heat of the working fluid inside the thermoduct 1, heat is dissipated. The inner wall of the tube 10 has multiple trenches 12, which are used to increase the area of the inner surface of the tube 10 and raise the capillarity for working fluid; thus, the flow rate of the working fluid can be raised, and the working fluid can transfer the maximum amount of heat, and the thermal conductivity and the permeability of the thermoduct 1 is also promoted. In this embodiment, the trenches 12 can also be used to accommodate the cupric powder 20; thus, not only the amount of the cupric powder 20 adhering to the inner wall of the tube 10 can be increased, but also via the recesses of the trenches 12, the cohesiveness of the cupric powder 20 sintered to the inner wall of the tube 10 is raised.

The tube 10 is usually made of a cupric material of high thermal conductivity. A long cupric tube is cut into the desired length of the tube 10, and one end is converged and welded to form a sealed end 16 shown in FIG. 2. However, that mentioned above is not to limit but only to exemplify the method of forming the sealed end 16. The other end of the tube 10 is an open end 18, and after the capillary texture has been disposed inside the tube 10, the open end 18 is also sealed.

The fabrication process of the thermoduct 1 of this preferred embodiment is to be described below. Firstly, a metallic net 30 is inserted into the hollow portion 14 of the tube 10 via the open end 18. The metallic net 30 is formed via cross-weaving multiple longitudinal metallic threads 31 and multiple latitudinal metallic threads 32, and the metallic net 30 is usually made of a cupric material of high thermal conductivity. The metallic net 30 can raise the capillarity for the working fluid. The radius of the metallic net 30 is slightly less than the inner radius of the tube 10 so that there is a gap between the metallic net 30 and the inner wall of the tube 10, and the cupric power 20 is to be contained inside the gap. The metallic net 30 is to take the place of the aforementioned cupric rod 110. After the metallic net 30 has been inserted in the tube 10, the cupric powder 20 is filled into the gap between the metallic net 30 and the inner wall of the tube 10, i.e. contained inside the trenches 12. During the process of filling the cupric powder 20, the cupric powder 20 needs to be vibrated in order to compact it. The capillarity for the working fluid can be raised by the cupric powder 20 also. Then, the cupric powder 20 and the metallic net 30 are sintered at high temperature in order to adhere to the inner wall of the tube 10. Then, the tube 10 is evacuated, and the working fluid (not shown in the drawing) is filled into the tube 10, and lastly, the open end 18 is sealed.

In this preferred embodiment of the present invention, the metallic net 30 not only can function as the capillary texture to increase the capillarity of the tube 10, but also can take the place of the cupric rod 110 in the conventional technology to confine the cupric powder 20 inside the gap between the metallic net 30 and the inner wall of the tube 10, i.e. to confine the cupric powder 20 inside the trenches 12. After sintering, not only the metallic net 30 can adhere to the inner wall of the tube 10, but also the drawing-out process as that of the cupric rod 110 in the conventional technology will be saved in the present invention. Therefore, the cupric powder 20 adhering to the inner wall of the tube 10 will not be lost but be maintained.

The trench 12, the cupric powder 20, or the metallic net 30 has its own efficacy respectively, but those are all used to enhance the thermal conduction of the thermoduct 1. Therefore, combining those three measures into a single thermoduct 1 not only can mutually compensate the disadvantages thereof, but also the thermoduct 1 can has a further superior heat-dissipating performance.

Figure 4:
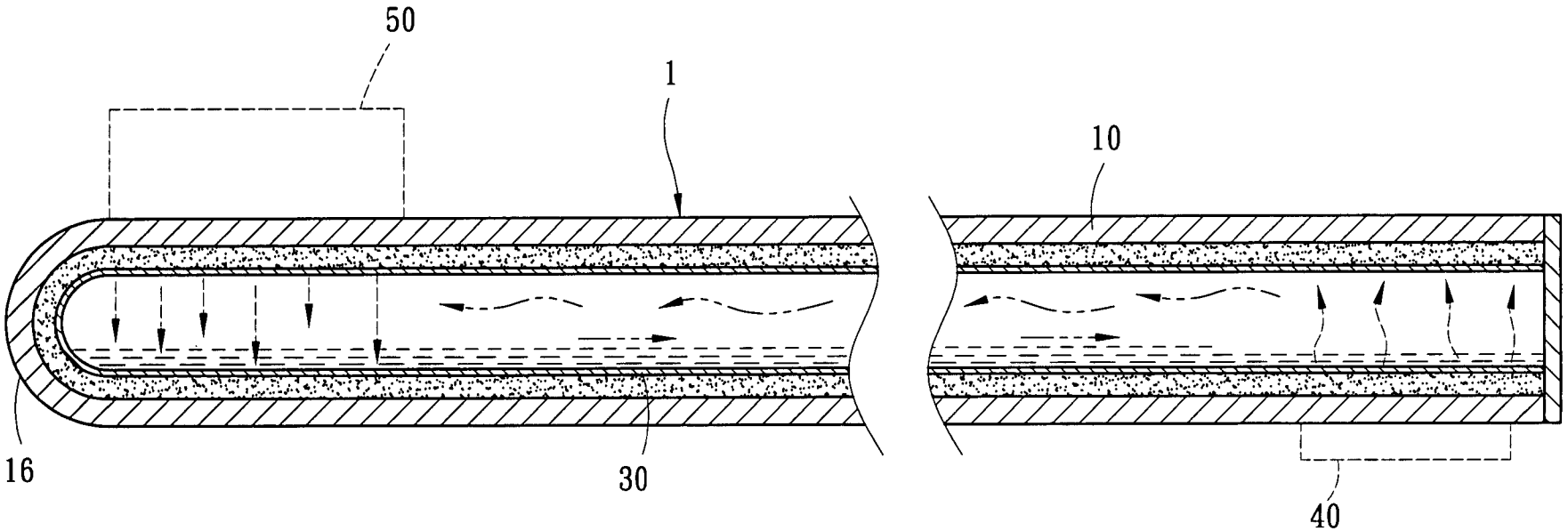
FIG. 4 shows schematically a practical application of the thermoduct according to one embodiment of the present invention.

Refer to FIG. 4. When the thermoduct 1 of this embodiment is applied in practice, one end of the thermoduct 1 contacts a heat source 40, and the other end contacts a cooling device 50. The heat source 40 can be a power-consuming chip, CPU, or LCD, etc., and the cooling device 50 can be heat-dissipating fins, which dissipate heat via natural convection, or an electric fan, which dissipates heat via enforced air cooling. As the exterior of the tube 10 is in vacuum state, the internal working fluid will be evaporated at 30° C. When the end contacting the heat source 40 absorbs the heat emitted from the heat source 40, the liquid working fluid is evaporated into a gas phase, and the gas will flow through the channel to the other end contacting the cooling device 50. The cooling device 50 dissipates the heat, and the working fluid will then condense into a liquid phase. The condensed working fluid will flow through the trenches 12, the cupric powder 20, and the metallic net 30 inside the thermoduct 1 back to the end contacting the heat source 40. Thus, a cycle of absorbing/dissipating heat is completed, and thereby, the heat can be effectively taken away.

In summary, via the combination of the tube 10 with the trenches 12, the cupric powder 20 and the metallic net 30, and via the metallic net 30's taking the place of the conventional cupric rod 110, the cupric power 20 can well adhere to the trenches 12, and the thermoduct 1 of the present invention can has superior capillarity, thermal conductivity, and permeability; thus, the thermoduct 1 of the present invention has superior heat-dissipating ability; further, the present invention also has the advantages of easy fabrication and low cost.

Those described above are not to limit the scope of the present invention but only to exemplify the present invention with the preferred embodiments. Any modification and variation made by the person skilled in the art according to the spirit of the present will not depart from the scope of the present invention and is to be included within the scope of the present invention.

What is claimed is:

1. A thermoduct, achieving heat dissipation via the cycling of absorbing/dissipating heat of a working fluid inside said thermoduct, and comprising:

a tube, being a hollow metallic piping with a plurality of trenches;

a metallic net, disposed inside said tube, wherein there is a gap between said metallic net and the inner wall of said tube; and cupric powder, contained inside said gap, and sintered to fixedly adhere to the recesses of said plurality of trenches.

2. The thermoduct according to claim 1, wherein said tube is made of a cupric material.

3. The thermoduct according to claim 1, wherein said metallic net is made of a cupric material.

4. The thermoduct according to claim 1, wherein said metallic net is sintered to fixedly adhere to the inner wall of said tube.

* * * * *